US006042245A

United States Patent [19]

Stanley

[11] Patent Number: 6,042,245

[45] Date of Patent: Mar. 28, 2000

[54] SWITCH ATTACHMENT

[76] Inventor: Terry D. Stanley, 1222 S. River Rd., Janesville, Wis. 53546

[21] Appl. No.: 09/054,250

[22] Filed: Apr. 2, 1998

[51] Int. Cl.[7] ..... F21V 21/32; H01H 9/06; F41B 5/14

[52] U.S. Cl. ..... 362/191; 362/109; 362/253; 362/399; 33/265; 124/87; 200/293.1

[58] Field of Search ..... 33/241, 265; 124/87, 124/88; 200/293.1, 295, 329, 332.2, 333, 338; 362/189, 198, 191, 205, 253, 399, 400, 109

[56] References Cited

U.S. PATENT DOCUMENTS

| | | | |
|---|---|---|---|
| 3,710,054 | 1/1973 | Koenig | 200/86 R |
| 4,293,752 | 10/1981 | Koenig | 200/333 |
| 4,495,705 | 1/1985 | Kowalski et al. | 124/87 |
| 5,375,047 | 12/1994 | Mueller | 124/87 |
| 5,435,068 | 7/1995 | Thames et al. | 33/265 |
| 5,654,594 | 8/1997 | Bjornsen, III et al. | 200/293.1 |

*Primary Examiner*—Alan Cariaso

[57] ABSTRACT

A new switch attachment for selectively activating an illuminated sight pin of a bow sighting device. The inventive device includes an outer casing comprising resilient compressible material. The outer casing is designed for attachment to the hand grip of a bow. A pair of spaced apart strips are provided in the interior of the outer casing. A pair of resiliently compressible spacers are provided in the interior of the outer casing between the strips. Electrically connected to each of the strips is a flexible wire which are designed for electrically connecting to an illuminated sight pin device.

8 Claims, 2 Drawing Sheets

SWITCH ATTACHMENT

BACKGROUND OF THE INVENTION

1. Field of the Invention

The present invention relates to illuminated bow sight devices and more particularly pertains to a new switch attachment for selectively activating an illuminated sight pin of a bow sighting device.

2. Description of the Prior Art

The use of illuminated bow sight devices is known in the prior art. More specifically, illuminated bow sight devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art illuminated bow sight devices include U.S. Pat. No. 5,375,047; U.S. Pat. No. 4,928,394; U.S. Pat. No. Des. 305,030; U.S. Pat. No. 5,201,122; and U.S. Pat. No. 5,379,747.

While these devices fulfill their respective, particular objectives and requirements, the aforementioned patents do not disclose a new switch attachment. The inventive device includes an outer casing comprising resilient compressible material. The outer casing is designed for attachment to the hand grip of a bow. A pair of spaced apart strips are provided in the interior of the outer casing. A pair of resiliently compressible spacers are provided in the interior of the outer casing between the strips. Electrically connected to each of the strips is a flexible wire which are designed for electrically connecting to an illuminated sight pin device.

In these respects, the switch attachment according to the present invention substantially departs from the conventional concepts and designs of the prior art, and in so doing provides an apparatus primarily developed for the purpose of selectively activating an illuminated sight pin of a bow sighting device.

SUMMARY OF THE INVENTION

In view of the foregoing disadvantages inherent in the known types of illuminated bow sight devices now present in the prior art, the present invention provides a new switch attachment construction wherein the same can be utilized for selectively activating an illuminated sight pin of a bow sighting device.

The general purpose of the present invention, which will be described subsequently in greater detail, is to provide a new switch attachment apparatus and method which has many of the advantages of the illuminated bow sight devices mentioned heretofore and many novel features that result in a new switch attachment which is not anticipated, rendered obvious, suggested, or even implied by any of the prior art illuminated bow sight devices, either alone or in any combination thereof.

To attain this, the present invention generally comprises an outer casing comprising resilient compressible material. The outer casing is designed for attachment to the hand grip of a bow. A pair of spaced apart strips are provided in the interior of the outer casing. A pair of resiliently compressible spacers are provided in the interior of the outer casing between the strips. Electrically connected to each of the strips is a flexible wire which are designed for electrically connecting to an illuminated sight pin device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new switch attachment apparatus and method which has many of the advantages of the illuminated bow sight devices mentioned heretofore and many novel features that result in a new switch attachment which is not anticipated, rendered obvious, suggested, or even implied by any of the prior art illuminated bow sight devices, either alone or in any combination thereof.

It is another object of the present invention to provide a new switch attachment which may be easily and efficiently manufactured and marketed.

It is a further object of the present invention to provide a new switch attachment which is of a durable and reliable construction.

An even further object of the present invention is to provide a new switch attachment which is susceptible of a low cost of manufacture with regard to both materials and labor, and which accordingly is then susceptible of low prices of sale to the consuming public, thereby making such switch attachment economically available to the buying public.

Still yet another object of the present invention is to provide a new switch attachment which provides in the apparatuses and methods of the prior art some of the advantages thereof, while simultaneously overcoming some of the disadvantages normally associated therewith.

Still another object of the present invention is to provide a new switch attachment for selectively activating an illuminated sight pin of a bow sighting device.

Yet another object of the present invention is to provide a new switch attachment which includes an outer casing comprising resilient compressible material. The outer casing is designed for attachment to the hand grip of a bow. A pair of spaced apart strips are provided in the interior of the outer casing. A pair of resiliently compressible spacers are provided in the interior of the outer casing between the strips. Electrically connected to each of the strips is a flexible wire which are designed for electrically connecting to an illuminated sight pin device.

Still yet another object of the present invention is to provide a new switch attachment that allows a user to selectively activate the illumination of an illuminated sight pin of a bow sight even when the user is drawing back the bow the bow sight is mounted to.

Even still another object of the present invention is to provide a new switch attachment that reduces the drain on the battery power source of an illuminated sight pin by allowing selective activation of the illumination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
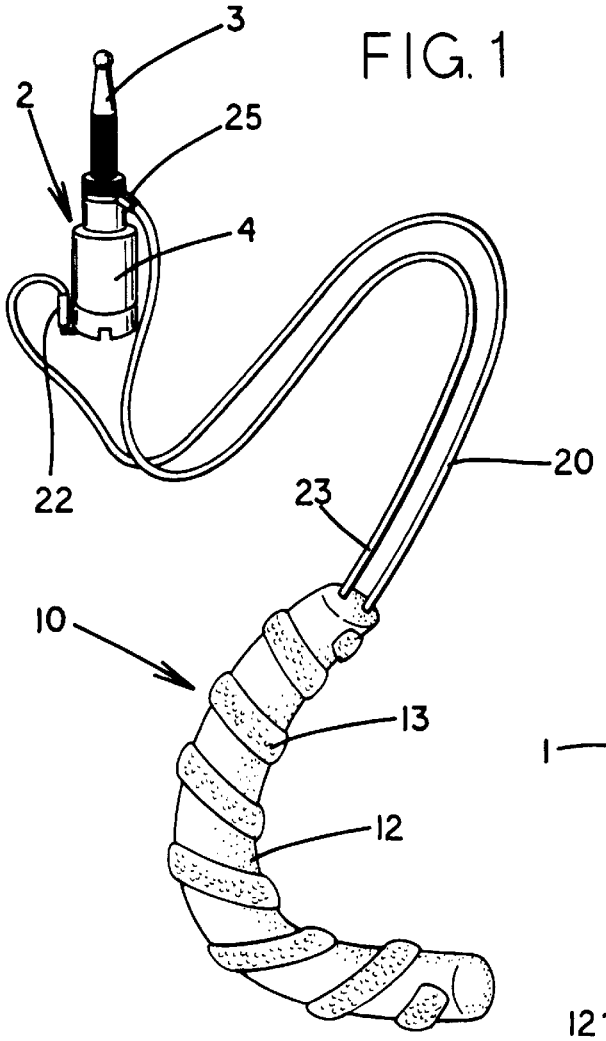
FIG. 1 is a schematic perspective view of a new switch attachment connected to a illuminated sight pin device according to the present invention.
Figure 2:
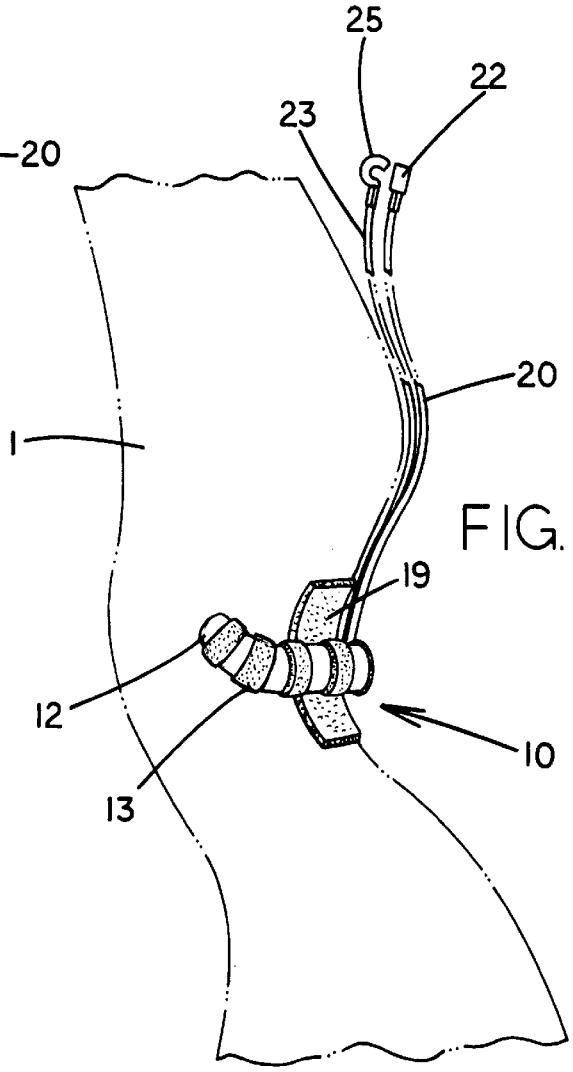
FIG. 2 is a schematic perspective view of the present invention attached to the handgrip of a bow.
Figure 3:
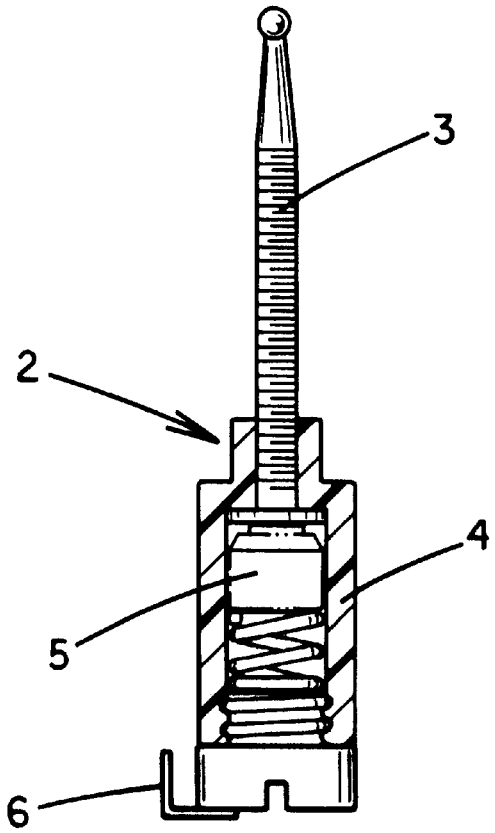
FIG. 3 is a schematic cross sectional view of an illuminated sight pin device.
Figure 4:
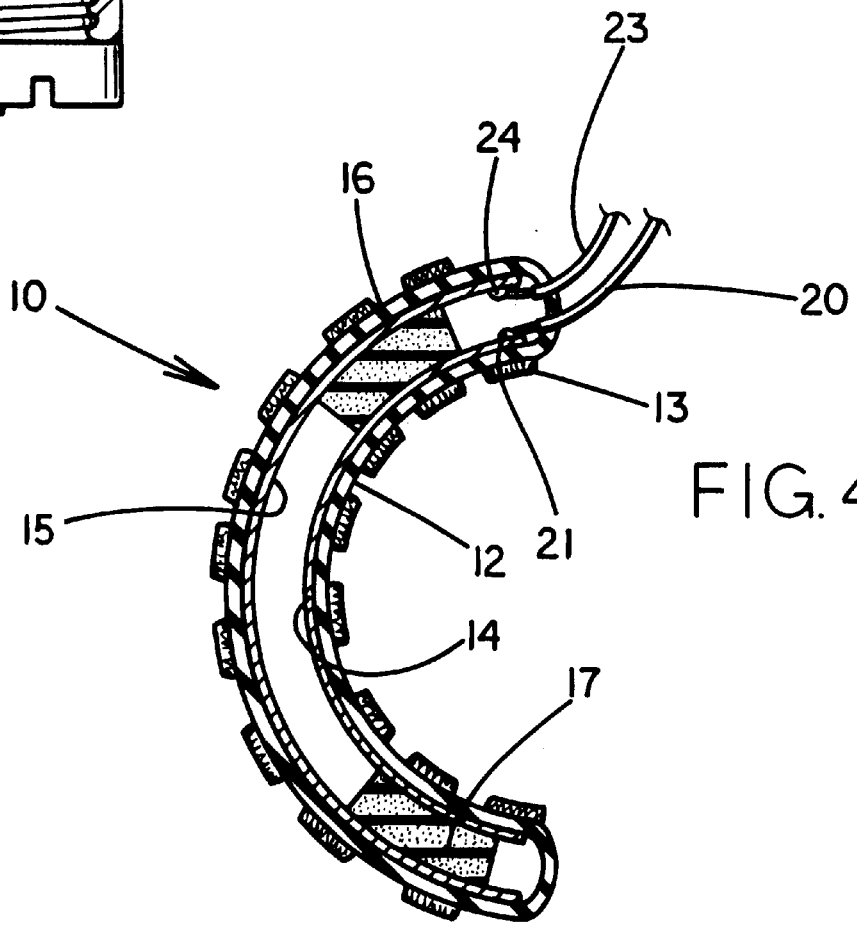
FIG. 4 is a schematic sectional view of the present invention.

With reference now to the drawings, and in particular to FIGS. 1 through 4 thereof, a new switch attachment embodying the principles and concepts of the present invention and generally designated by the reference numeral 10 will be described.

As best illustrated in FIGS. 1 through 4, the switch attachment 10 generally comprises an outer casing 12 comprising resilient compressible material. The outer casing 12 is designed for attachment to the handgrip 1 of a bow. A pair of spaced apart strips 14,15 are provided in the interior of the outer casing 12. A pair of resiliently compressible spacers 16,17 are provided in the interior of the outer casing 12 between the strips 14,15. Electrically connected to each of the strips 14,15 is a flexible wire 20,23 which are designed for electrically connecting to an illuminated sight pin device 2.

With reference to FIG. 1, the switch attachment is designed for use with an illuminated sight pin device 2 of a bow sight mounted on a bow having a handgrip I portion. The sight pin device 2 has an elongate illumination pin 3 and a battery housing 4 at one end of the pin 3. The battery housing 4 has a battery 5 therein. A spade connector 6 outwardly extends from the battery housing 4 and is electrically coupled to the battery 5. The illumination pin 3 is electrically connected to the battery 5. The illumination pin 3 provides light when energized.

Specifically, the switch attachment 10 comprises an elongate outer casing 12 which is preferably generally arcuate and has an hollow interior and a pair of opposite ends. The outer casing 12 preferably comprising a resiliently flexible and resilient compressible material, such as rubber.

A pair of spaced apart elongate strips 14,15 are provided in the interior of the outer casing 12. The strips 14,15 are electrically conductible and are preferably constructed from a metal such as copper. Ideally, the strips 14,15 are formed into a curved shape and are spaced apart less than ⅛ inch apart from each other. The lengths of the strips 14,15 extend between the ends of the outer casing 12. Ideally, the length of each of the strips 14,15 is less than about 1¾ inches. A pair of spacers 16,17 are provided in the interior of the outer casing 12 and are interposed between the strips 14,15 and preferably abut each of the strips 14,15. One of the spacers 16 is located towards one of the ends of the outer casing 12 while the other spacers 17 is located towards another of the ends of the outer casing 12. The spacers 16,17 are resiliently compressible and preferably comprise a foamed material.

A pair of elongate flexible wires 20,23, each having opposite first and second ends 21,24,22,25. The first end 21 of one of the wires 20 is electrically connected to one of the strips 14 while the first end 24 of the other wires 23 is electrically connected to the other strip 15. The second ends of the wires 20,23 are electrically connectable to an illuminated sight pin device 2 such that squeezing the strips 14,15 together completes a circuit to activate illumination of the illumination pin 3 of the illuminating sight pin device 2. Ideally, as shown in FIG. 1, the second end 25 of one of the wires 23 is electrically connectable to the illumination pin 3 of an illuminated sight pin device 2 and the second end 22 of the other wire 20 is electrically connectable to the spade connector 6 of an illuminated sight pin device 2.

As illustrated in FIG. 1, the outer casing 12 is designed for attachment to a handgrip I of a bow. Preferably, a hook and loop fastener is provided for detachably attaching the outer casing 12 to the handgrip 1 of a bow. Ideally, the outer casing 12 has a portion 13 of a hook and loop fastener provided thereon. The portion 13 of the hook and loop fastener is preferably arranged into an elongate coil on the outer casing 12 extending between the ends of the outer casing 12. The portion 13 of the hook and loop fastener is designed for attachment to a complementary portion 19 of a hook and loop fastener provided on a handgrip 1 of a bow to attach the outer casing 12 to the handgrip 1 of the bow.

In use, a user draws back the bow having a switch device 10 mounted on the handgrip of the bow and electrically connected to the illuminated sight pin device. As the bow is drawn back, the user applies pressure on the outer casing to squeeze the strips together to complete the circuit and activate the illumination pin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A switch attachment for an illuminated sight pin device, said switch attachment comprising:

an outer casing having an interior and a pair of ends;

said outer casing comprising resilient compressible material;

a pair of spaced apart strips being provided in said interior of said outer casing;

a pair of spacers being provided in said interior of said outer casing and being interposed between said strips;

said spacers being resiliently compressible;

a pair of elongate flexible wires, each of said wires having opposite first and second ends, said first end of one of said wires being electrically connected to one of said strips, said first end of said another of said wires being electrically connected to another of said strips;

said second ends of said wires being adapted for electrically connecting to an illuminated sight pin device;

wherein said outer casing, has a portion of a hook and loop fastener provided thereon said portion of said hook and loop fastener being adapted for attachment to a complementary portion of a hook and loop fastener provided on a hand grip of a bow to attach the outer casing to the hand drip of the bow; and wherein said portion of said hook and loop fastener is arranged into an elongate coil on said outer casing extending between said ends of said outer casing.

2. The switch device of claim 1, wherein said outer casing is generally arcuate and further comprises a resiliently flexible material.

3. The switch device of claim 2, wherein said outer casing comprises rubber.

4. The switch device of claim 1, wherein each of said strips has a length, said lengths of said strips being extended between said ends of said outer casing.

5. The switch device of claim 1, wherein one of said spacers is located towards one of said ends of said outer casing, and another of said spacers is located towards another of said ends of said outer casing.

6. The switch device of claim 1, wherein said spacers comprise a foamed material.

7. The switch device of claim 1, wherein said second end of one of said wires is electrically connectable to an illumination pin of the illuminated sight pin device, wherein said second end of another of said wires is electrically connectable to the connector of the illuminated sight pin device.

8. A switch attachment for an illuminated sight pin device of a bow sight mounted on a bow having a handle grip portion, the sight pin device having an elongate illumination pin and a battery housing at one end of the pin, the battery housing having a battery therein and having a connector extending therefrom, the connector being electrically coupled to the battery, the illumination pin being electrically connected to the battery, said illumination pin providing light when energized, said switch attachment comprising:

an outer casing being generally arcuate and having an interior and a pair of opposite ends;

said outer casing comprising a resiliently flexible and resilient compressible material;

wherein said outer casing comprises rubber;

a pair of spaced apart strips being provided in said interior of said outer casing, said strips being electrically conductible;

each of said strips having a length, said lengths of said strips being extended between said ends of said outer casing;

a pair of spacers being provided in said interior of said outer casing and being interposed between said strips;

one of said spacers being located towards one of said ends of said outer casing, another of said spacers being located towards another of said ends of said outer casing;

said spacers being resiliently compressible;

wherein said spacers comprise a foamed material;

a pair of elongate flexible wires, each of said wires having opposite first and second ends, said first end of one of said wires being electrically connected to one of said strips, said first end of said another of said wires being electrically connected to another of said strips;

said second ends of said wires being electrically connectable to the illuminated sight pin device such that squeezing said strips together activates illumination of the illumination pin of the illuminating sight pin device, wherein said second end of one of said wires being electrically connectable to the illumination pin of the illuminated sight pin device, wherein said second end of another of said wires being electrically connectable to the connector of the illuminated sight pin device; and said outer casing having a portion of a hook and loop fastener provided thereon, said portion of said hook and loop fastener being arranged into an elongate coil on said outer casing extending between said ends of said outer casing, said portion of said hook and loop fastener being adapted for attachment to a complementary portion of a hook and loop fastener provided on a hand grip of a bow to attach the outer casing to the hand grip of the bow.

* * * * *